United States Patent [19]

Gell

[11] Patent Number: 4,536,081

[45] Date of Patent: Aug. 20, 1985

[54] DATA COPY SYSTEM

[76] Inventor: Harold A. Gell, 13720 Lockdale Rd., Silver Spring, Md. 20906

[21] Appl. No.: 464,853

[22] Filed: Feb. 8, 1983

[51] Int. Cl.[3] ..... G03C 3/00

[52] U.S. Cl. ..... 355/20; 354/76; 354/88; 430/138; 430/207

[58] Field of Search ..... 355/20, 27, 133; 354/75, 76, 83–85, 88, 6; 358/332, 244; 346/110 R; 430/202, 208, 209, 496, 138, 207; 206/455, 484, 494, 578

[56] References Cited

U.S. PATENT DOCUMENTS

| | | | |
|---|---|---|---|
| T878,002 | 8/1970 | Elins et al. | 430/138 |
| 2,543,181 | 2/1951 | Land | 354/85 X |
| 3,339,020 | 8/1967 | Kaufman | 358/244 |
| 3,427,250 | 2/1969 | Haas et al. | 430/138 X |
| 3,586,501 | 6/1971 | Norquist et al. | 354/85 X |
| 3,615,541 | 10/1971 | Hubert | 354/84 X |

*Primary Examiner*—L. T. Hix
*Assistant Examiner*—Della Rutledge
*Attorney, Agent, or Firm*—Harold A. Gell

[57] ABSTRACT

A method and apparatus for photographically copying a light radiating image without the aid of an optical system by placing a photosensitive media directly on the image.

16 Claims, 9 Drawing Figures

DATA COPY SYSTEM

THE INVENTION

This invention relates to a method and apparatus for creating a photographic image of a cathode ray tube display.

BACKGROUND OF THE INVENTION

Modern technology has resulted in the mass production of inexpensive computers useful in managing the affairs of small businesses and average households. These devices generally include a cathode ray tube data display but lack provisions for a permanent, hard copy. Printers are available for most computers but they are not economically feasible for the average small computer system since they increase the cost of the system by at least an order of magnitude and fail to provide hard copy for all of the various graphics that the cathode ray tube is capable of displaying.

OBJECTIVES OF THE INVENTION

In view of the lack of an inexpensive means of providing a hard copy from any type of cathode ray tube computer display, or any similar computer display such as might be provided via flat panel display techniques, it is a primary objective of the present invention to provide a means for photographically reproducing such a display without the need of an extensive lens system or additional equipment.

A further objective of the present invention is to provide a simple, inexpensive film pack adapted to be directly exposed by a computer display and thus provide a same size image of the data contained thereon.

A still further objective of the present invention is to provide a photographic medium holder adapted to hold the photographic media against a light generating display means and which includes means to selectively expose said photographic media to the image created by the display.

Another objective of the present invention is to provide a photographic film pack including a light impervious shield for the film which may be removed and replaced to expose the film in the pack to a selected image.

It is a still further objective of the present invention to provide a photographic film pack including a film exposure opening and a light shield for closing the opening that may be selectively removed and replaced to expose the photographic film in combination with a photographic developer applicator means.

Another objective of the present invention is to provide a film pack having a light impervious shield with an opening therein that may be moved across the film at a controlled rate to expose film contained within the pack.

A still further objective of the present invention is to provide a light shutter device for film contained in a flat pack having an exposure opening therein wherein the shutter is comprised of an opening in an opaque shield that may be manually moved across the flat pack opening to selectively expose film contained therein.

A still further objective of the present invention is to provide a developer application means in combination with an exposure control slide means.

The foregoing and other objectives of the invention will become apparent in light of the drawings, specification and claims contained herein.

SUMMARY OF THE INVENTION

Presented hereby is a method and apparatus for making a hard copy of an image presented by a cathode ray tube or similar light generating display means. The hard copy is in the form of a photographic image that may be created by any of the well known photographic techniques such as the common silver or ferric salt techniques including the instant photographic techniques perfected by the Polaroid Land Corporation and Eastman Kodak Company. The apparatus of the invention is comprised of a sheet of photographic material contained in a light impervious container such as a simple envelope or bag having an opening therein shielded by a light impervious member that may be removed as the assembly is held against a display to thereby expose the film within the container. The same shield or an additional shield closes the exposure opening to protect the exposed photographic media until it can be developed by whatever process is required. In certain embodiments of the invention, developer chemicals are applied by an applicator within the package during the closure portion of the exposure operation to provide quick, on-site development of the photographic media.

DESCRIPTION OF THE INVENTION

Figure 1:
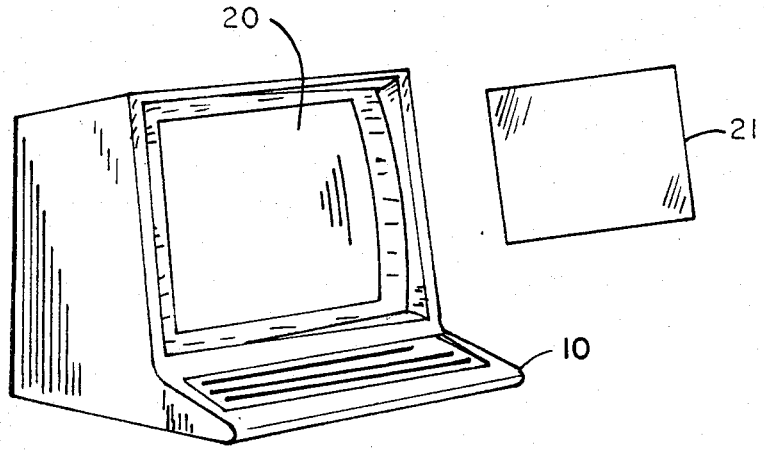
FIG. 1 is a front $\frac{3}{4}$ view of the film holder of the present invention placed for exposure by a cathode ray tube display.

FIG. 1 illustrates a standard television receiver 10 of the type normally used as a display means for small computer systems. A copy pack 20 is held against the CRT over the images to be copied and the film contained therein is exposed by removing the light impervious protective shield 21.

The operation of the system as illustrated in FIG. 1 is comprised of placing the copy pack against the face of the CRT, holding it there while the light impervious shield 21 or similar shield device is removed to expose the photosensitive material in the copy pack to the image for a predetermined period of time. A shield is then placed over the photosensitive material which is subsequently developed to provide the desired image. The photosensitive media contained in the film pack 20 of FIG. 1 may use the silver or ferric salt techniques or electrostatic techniques for creating an image. Whichever photographic technique is utilized, suitable developing materials may be contained in the pack to facilitate on-site development.

FIGS. 2, 4, 6, and 9 illustrate the use of an applicator which is an optional element of each embodiment for applying a developer or fixing material to the photosensitive media. In some versions of those embodiments, the applicator may be dispensed with and the photosensitive media may be developed by using standard techniques at a remote site. If Polaroid or Kodak "instant" type photosensitive media is used, the applicators may be in the form of pods containing a viscous reagent or developer that is ruptured through the application of pressure to release the developer so that it may be evenly spread across the surface of the exposed photosensitive media. In a preferred embodiment of the invention, the surface of the opaque shield used to cover the exposed photosensitive media is provided with a surface of microspheres that contain the required developing agent. This preferred embodiment is utilized by crushing the microspheres to release the developer by applying pressure through the use of a small roller or burnishing blade to either the back of the photosensitive media or the exterior surface of the light shield bearing the developer containing microspheres after the photosensitive media is exposed and the light shield is placed over it.

It is further anticipated that adaptations of the various embodiments illustrated herein may use a photosensitive media that is processed at a remote site. In this case, no developer is contained in the copy pack and the exposed photosensitive media is sealed in the light impervious assembly for transport to the developing facility.

Figure 2:
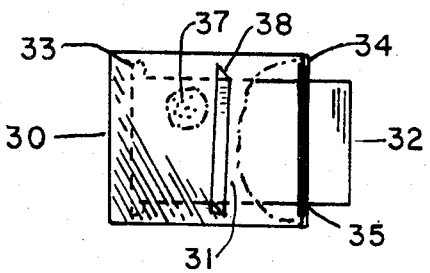
FIG. 2 schematically illustrates a first embodiment of the present invention wherein exposure of the photographic media is achieved by pulling the container off of the media.

FIG. 2 illustrates one of the simpler embodiments of the present invention. In this embodiment a copy bag 30 fabricated from a light impervious material houses the photosensitive media 31. The photosensitive media 31 has a tab 32 extending from an opening in the bag and stop means 33 at the opposite end of the photosensitive media adapted to cooperate with restrictions 34 in the opening of the bag 30 so that the bag may not be pulled completely off of the photosensitive media. If on-site development is desired, a developer or fixing reagent in an applicator strip 35 is positioned along the inner surface of the bag 30 at the opening and on the exposure side of the pack.

Tab 32 of FIG. 2 may be provided with an adhesive surface to facilitate the copying process.

In operation, the embodiment illustrated in FIG. 2 is placed against a CRT face bearing an image to be copied. Tab 32 is held in position manually by the user's hand or, if provided with an adhesive surface, it is temporarily secured to the face of the CRT or frame thereof. The envelope or bag 30 of the copy pack is then slid off of the photosensitive media 31 while the media is held against the face of the CRT. After the desired exposure time, the bag is slid back over the photosensitive media to protect it while it is being transported to a development station.

If the embodiment illustrated in FIG. 2 includes the on-site development feature, the developer contained in the developer applicator 35 is released by crushing a frangible container or removing a sealing means immediately prior to sliding the envelope 30 back over the film. As the envelope 30 is slid over the film 31, the development chemicals are applied to the exposed surface of the film and the image is developed, after which, the envelope 30 may be removed and discarded. In an alternate embodiment of this invention, the development materials may be contained on an absorbent member that may be contained in a separate container and removed from the container to be wiped across the face of the exposed photosensitive media. In this alternate embodiment, exposure times required by the film are generally relatively long so that it is not necessary to protect the exposed photosensitive media by sliding it back in the envelope 30. In this embodiment, stops 33 are not required and the bag is simply removed from the photosensitive material and discarded or saved for future use. After exposure is complete, the photosensitive material is removed from the face of the cathode ray tube and the developer is immediately wiped across the face thereof to begin the development process before the image is destroyed by the ambient light.

In the preferred adaptation of the embodiment illustrated in FIG. 2, the inner surface of envelope 30 is provided with a plurality of microspheres or microcapsules 37 containing a developer. After exposure, the film or photosensitive media is slid back into the envelope so that the exposed surface of the photosensitive media 31 is in contact with the microspheres 37 within the envelope 30. A roller or burnishing tool 38 is then drawn over the surface of the envelope 30 to crush the microcapsules 37 and release the developer.

Figure 3:
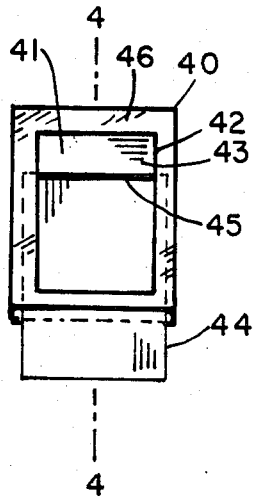
FIG. 3 is a schematic representation of an alternate embodiment of the present invention wherein a light impervious protective cover is removed from the film pack to expose the film contained therein.

FIG. 3 illustrates a further embodiment of the present invention wherein the photosensitive material 41 is secured within the copy pack envelope 40. The envelope 40 includes an opening 42 through which the photosensitive material 41 is exposed. The opening 42 may be closed by a transparent film means 43 such as cellophane or plastic to protect the photosensitive media and provide package continuity and to facilitate the ease with which the shutter or protective member 44 may be slid in and out of the package to expose the photosensitive material during imaging.

A restrictor or tab 45 may be provided on the shutter member 44 to restrict its removal from envelope 40 so that when the copy pack is held against the CRT and the shutter pulled out, it may easily be slid back in place after the proper exposure time.

In the embodiment illustrated in FIG. 3, the copy pack is held against the face of the CRT during exposure manually or if desired, the edges 46 of the copy pack envelope 40 may be provided with an adhesive that will temporarily secure the copy pack to the face of the CRT while shutter 44 is pulled out and then returned after exposure.

Figure 4:
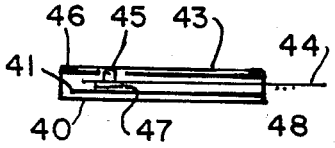
FIG. 4 is a side, cutaway, schematic view of the film pack assembly illustrated in FIG. 3 taken along 4—4.

FIG. 4 is a side view of the embodiment illustrated in FIG. 3. In this view, the reagent applicator 47 may be seen immediately beneath the tab 45 which prevents complete removal of shutter 44.

The method of utilizing the embodiment illustrated in FIGS. 3 and 4 consists of securing the copy pack to the face of the CRT either by manually holding it there or affixing it thereto temporarily via the adhesive along the edges 46 of the envelope 40. When copy pack is in place and the image is on the CRT, shutter 44 is pulled out of envelope 40 until the proper exposure time has elapsed. After exposure, the shutter 44 is slid back into the envelope 40 and the copy pack may be removed for development. If the on-site development feature is included in this embodiment, the applicator 47 is activated either by crushing a frangible container to release the reagent or removing a seal to release the material into the applicator before shutter 44 is slid back into the envelope. To ensure proper coating of the photosensitive surface 41 with the developer contained in applicator 47, shutter 44 may be moved back and forth within the envelope 40 a number of times after exposure.

The preferred adaptation of the embodiment illustrated in FIGS. 3 and 4 includes a plurality of microspheres 48 on the surface of the shutter 44 which faces the photosensitive media 41. After exposure, the shutter is slid back into the envelope 40 and developer contained in the microspheres 48 is released through the crushing action of a roller or burnishing tool as suggested for the embodiment illustrated in FIG. 2.

When development has been completed, the envelope 40 may be opened and discarded or the shutter device may be discarded leaving the hard copy protected within the envelope.

Figure 5:
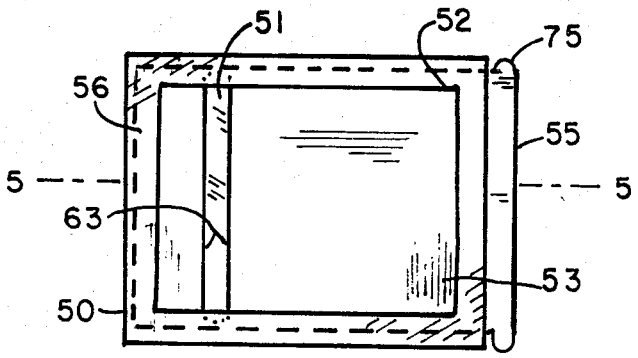
FIG. 5 is an exposure side, schematic view of a preferred embodiment of the present invention utilizing an exposure slot.

FIG. 5 illustrates a preferred embodiment of the present invention wherein the photosensitive film material 51 is secured within an envelope container 50 which forms the copy pack having an opening 52 through which the photosensitive material may be exposed. This opening may be further protected by a transparent member 53 which may be fabricated from a plastic material or cellophane. A shutter member 55 provides a light impervious barrier over the photosensitive media 51 when a copy pack is not in use, and an adhesive coating may be applied to the rim 56 surrounding the exposure opening 52 to facilitate holding the copy pack against the face of the CRT during shutter operation or exposure.

Figure 6:
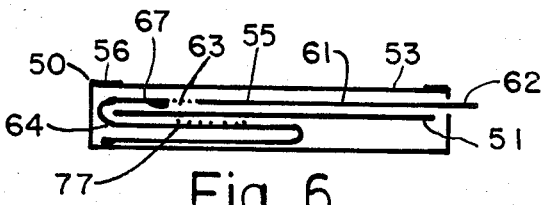
FIG. 6 is a side, cutaway, schematic view of the embodiment illustrated in FIG. 5 taken along 5—5.

FIG. 6 is a side cutaway view of the embodiment illustrated in FIG. 5 and it further illustrates the configuration of shutter member 55. Shutter member 55 consists of a storage segment 61 which covers the photosensitive surface of media 51 until the copy pack is exposed. Segment 61 extends from the envelope 50 a short distance to provide a hand-hold 62 which will enable an operator to grasp the shutter 55 and pull it from container 50.

An opening 63 of a predetermined width separates the first portion of the shutter 61 from a second portion of the shutter 64. The second portion 64 of the shutter 55 is opaque and pliable so that as the shutter 55 is pulled from container 50, the photosensitive media 51 will be exposed through slot 63. This provides for increased copy fidelity by allowing the use of faster reacting photosensitive material than were used in the prior embodiments. The opening 63 of the shutter 55 may be varied in dimension so that the exposure time of the photosensitive material will be fairly short as the shutter is pulled out of the container at an average speed. Thus this embodiment may use a wide range of photosensitive medias with the required exposure time controlled by the width of the shutter opening 63. The flexible portion 64 of shutter 55 may be secured to the end of the container 50 opposite the opening as illustrated in FIG. 6 to prevent the protective segment 64 from being withdrawn from the container 50 after exposure.

If on-site development is desired, a reagent applicator 67 may be attached to the leading edge of segment 64 of shutter 55 so that the developer may be applied as soon as the exposure slot 63 passes a given point on the photosensitive material 51. In this embodiment, the applicator 67 may be activated via a frangible technique or removal of a sealing strip etc. in the fashion which may be utilized by any of the other embodiments utilizing on-site development techniques.

The method of utilizing the embodiment illustrated in FIGS. 5 and 6 to create a hard copy of a computer display is comprised of securing the copy pack to the face of the CRT over the image to be copied. The finger tab 62 of shutter 55 is grasped and the shutter is withdrawn from the envelope 50 at an average speed calculated to provide the required exposure time as a function of the width of exposure slot 63 in the shutter assembly 55. When the shutter is withdrawn to its limit, the light impervious segment 64 protects the exposed photosensitive media 51 from ambient light and the copy pack may be removed and transported to a remote area for development. If on-site development techniques are utilized and the applicator 67 contains developer, it is activated before the shutter is pulled from the package and the operator waits a predetermined time for development to be completed before removing the photosensitive material and resultant image from the copy pack. If the developer is in microstructures 77, they are crushed after exposure of the film by applying pressure and the applicator may then be used as explained above to apply a fixing reagent.

Figure 7:
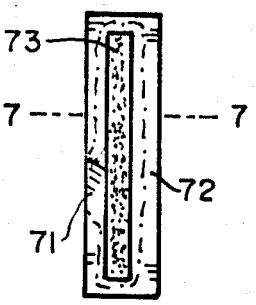
FIG. 7 is a top view of an alternate developer applicator.
Figure 8:
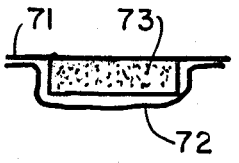
FIG. 8 is a cutaway edge view of the applicator of FIG. 7 taken along 7—7.

An alternate developer assembly applicator is illustrated in FIGS. 7 and 8. This assembly is comprised of a moisture impervious backing 71 which may have an adhesive coating 72 on one side which holds an applicator 73 saturated with developer and a removable moisture impervious cover 74. To use this device, the cover 74 is pealed off the developer assembly, the applicator 73 is placed in the exposure slot 63 of FIG. 5 or 8 and the backing 71 is pressed against the shutter 55. The pressure sensitive adhesive 72 on the edges of the backing 71 which was exposed when the cover 74 was removed holds the applicator in place over the exposure opening 63 so that developer will be applied to the exposed photosensitive material 51 as the shutter member 55 is drawn back to its original position as illustrated in FIG. 8.

In the embodiment illustrated in FIG. 8, the shutter may be fabricated from a sheet of opaque plastic film with a slot cut out to form the shutter opening 63. The ends of the film may be configured to prevent complete withdrawal of the film 55 from the envelope container 50 by their shape 75 as illustrated in FIG. 5 or by thickening 76 as illustrated in FIG. 9.

Figure 9:
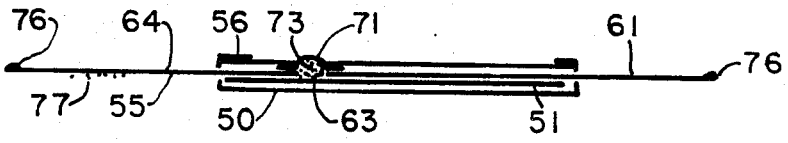
FIG. 9 is a cutaway, schematic view of an alternate embodiment of the preferred embodiment of FIG. 5 taken along 5—5.

In the preferred adaptation of the embodiments illustrated in FIGS. 6 and 9, development material is contained in microcapsules 77 located on the side of the segment 64 of the shutter 55 which covers the photosensitive media 51 after exposure through the slot 63. In this embodiment, the microspheres or capsules 77 are crushed by a roller or burnishing tool in a manner similar to that suggested for the embodiment illustrated in FIG. 2. When crushed, the microspheres 77 release the amount of developer required to create an image on the exposed photosensitive media. The applicator 73 may then be used to apply a fixing reagent in a fashion similar to that suggested for utilizing the applicator 73 for applying a developer.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is:

1. An apparatus for copying an image on an image display means, comprising:

a photosensitive media;

a container for said photosensitive media adapted to hold said photosensitive media adjacent to said image display means;

an exposure opening in said container through which said photosensitive media may be exposed;

an opaque cover for said photosensitive media dimensioned to render said exposure opening light impervious;

means to permit at least partial removal of said opaque cover from said exposure opening while said photosensitive media is held adjacent to said image display means by said container, including an edge opening in said container for passing said opaque cover therethrough and between said exposure opening and said photosensitive media;

stop means on said opaque cover for preventing the complete removal of said opaque cover from said container through said edge opening; and a developer applicator affixed to said opaque cover for applying developer to said photosensitive media.

2. An apparatus for copying an image on an image display means, comprising:

a photosensitive media;

a container for said photosensitive media adapted to hold said photosensitive media adjacent to said image display means;

an exposure opening in said container through which said photosensitive media may be exposed;

an opaque cover for said photosensitive media dimensioned to render said exposure opening light impervious, including an exposure slot for exposing said photosensitive media as said exposure slot is passed thereover;

a first opaque section;

a second opaque section separated by said exposure slot from said first opaque section;

said first and second opaque sections dimensioned to cover said photosensitive media except in the area of said exposure slot while said exposure slot is moved from one end of said photosensitive media to the other;

the width of said exposure slot is dimensioned relative to the light sensitivity of said photosensitive media whereby proper exposure time of said photosensitive media is provided by the action of manually pulling said first opaque section from said container; and means to permit at least partial removal of said opaque cover from said exposure opening while said photosensitive media is held adjacent to said image display means by said container.

3. An apparatus as defined in claim 2, comprising:

a plurality of frangible microstructures containing developer for said photosensitive media affixed to said second opaque section.

4. An apparatus as defined in claim 2, wherein said means to permit at least partial removal of said opaque cover comprises:

a forward edge opening in said container for passing said opaque cover therethrough and between said exposure opening and said photosensitive media; and means to secure one edge of said opaque cover within said container to prevent said opaque cover from being pulled completely off of said photosensitive media and out of said container.

5. An apparatus as defined in claim 4, further comprising:

a reagent applicator secured to said second opaque section adjacent to said exposure slot for applying a reagent to said photosensitive media after said photosensitive media is exposed through said exposure slot as said opaque cover is drawn from said container.

6. An apparatus as defined in claim 2, further comprising a reagent applicator including:

a moisture impervious substrate;

a reagent bearing media secured to said substrate;

a moisture impervious cover;

a pressure sensitive adhesive on said substrate surrounding said reagent bearing media for sealing said cover to said substrate to form a storage container for said reagent bearing media and for securing said reagent applicator to said opaque cover when said cover is removed; and said reagent bearing media is dimensioned to fit within said exposure slot in said opaque cover and said substrate is dimensioned to permit engagement of said pressure sensitive adhesive surfaces of said substrate with said first and second opaque sections while said reagent bearing media is positioned in said exposure slot.

7. An apparatus as defined in claim 2, comprising:

a first opening in said container for passing said first opaque section therethrough and between said opening and said photosensitive media; and a second opening in said container for passing said second opaque section therethrough and between said opening and said photosensitive media, said first and second openings adapted to permit said opaque cover to be pulled back and forth across said photosensitive media whereby said photosensitive media may be exposed through said exposure slot.

8. A method for creating a copy of a display, including the steps of:

placing a photosensitive media against said display; holding said photosensitive media in position with an adhesive means;

exposing said photosensitive media to said display for a predetermined period of time; and developing the exposed image on said photosensitive media, by sliding an opaque cover having an exposure slot therein between said photosensitive media and said display.

9. A method for creating a copy of a display as defined in claim 8, wherein said developing process includes the further steps of:

affixing a developer bearing applicator over said exposure slot and drawing said exposure slot across the surface of said photosensitive media to thereby apply developer to the surface thereof.

10. An apparatus for copying an image on an image display means, comprising:

a photosensitive media;

a container for said photosensitive media adapted to hold said photosensitive media adjacent to said image display means;

an exposure opening in said container through which said photosensitive media may be exposed;

an opaque cover for said photosensitive media dimensioned to render said exposure opening light impervious;

means to permit at least partial removal of said opaque cover from said exposure opening while said photosensitive media is held adjacent to said image display means by said container; and said opaque cover includes, an exposure slot for exposing said photosensitive media as said exposure slot is passed thereover.

11. An apparatus as defined in claim 10, comprising:

a first opaque section;

a second opaque section separated by said exposure slot from said first opaque section;

said first and second opaque sections dimensioned to cover said photosensitive media except in the area of said exposure slot while said exposure slot is moved from one end of said photosensitive media to the other; and the width of said exposure slot is dimensioned relative to the light sensitivity of said photosensitive media whereby proper exposure time of said photosensitive media is provided by the action of manually pulling said first opaque section from said container.

12. An apparatus as defined in claim 11, comprising:

a plurality of frangible microstructures containing developer for said photosensitive media affixed to said second opaque section.

13. An apparatus as defined in claim 11, wherein said means to permit at least partial removal of said opaque cover comprises:

a forward edge opening in said container for passing said opaque cover therethrough and between said exposure opening and said photosensitive media; and means to secure one edge of said opaque cover within said container to prevent said opaque cover from being pulled completely off of said photosensitive media and out of said container.

14. An apparatus as defined in claim 13, further comprising:

a reagent applicator secured to said second opaque section adjacent to said exposure slot for applying a reagent to said photosensitive media after said photosensitive media is exposed through said exposure slot as said opaque cover is drawn from said container.

15. An apparatus as defined in claim 11, further comprising a reagent applicator including:

a moisture impervious substrate;

a reagent bearing media secured to said substrate;

a moisture impervious cover;

a pressure sensitive adhesive on said substrate surrounding said reagent bearing media for sealing said cover to said substrate to form a storage container for said reagent bearing media and for securing said reagent applicator to said opaque cover when said cover is removed; and said reagent bearing media is dimensioned to fit within said exposure slot in said opaque cover and said substrate is dimensioned to permit engagement of said pressure sensitive adhesive surfaces of said substrate with said first and second opaque sections while said reagent bearing media is positioned in said exposure slot.

16. An apparatus as defined in claim 11, comprising:

a first opening in said container for passing said first opaque section therethrough and between said opening and said photosensitive media; and a second opening in said container for passing said second opaque section therethrough and between said opening and said photosensitive media, said first and second openings adapted to permit said opaque cover to be pulled back and forth across said photosensitive media whereby said photosensitive media may be exposed through said exposure slot.

* * * * *